US009771255B1

(12) United States Patent
Pearson

(10) Patent No.: US 9,771,255 B1
(45) Date of Patent: Sep. 26, 2017

(54) STIRRUP DEVICE

(71) Applicant: Heather N. Pearson, Princeton, MN (US)

(72) Inventor: Heather N. Pearson, Princeton, MN (US)

( * ) Notice: Subject to any disclaimer, the term of this patent is extended or adjusted under 35 U.S.C. 154(b) by 216 days.

(21) Appl. No.: 14/637,217

(22) Filed: Mar. 3, 2015

Related U.S. Application Data

(60) Provisional application No. 62/085,861, filed on Dec. 1, 2014.

(51) Int. Cl.
*B68C 3/00* (2006.01)
*B68C 3/02* (2006.01)

(52) U.S. Cl.
CPC ..... *B68C 3/00* (2013.01); *B68C 3/02* (2013.01); *B68C 2003/0083* (2013.01)

(58) Field of Classification Search
CPC ..... B68C 2003/0083; B68C 3/00; B68C 2003/0008; B68C 2003/0091; B68C 3/02
See application file for complete search history.

(56) References Cited

U.S. PATENT DOCUMENTS 69,920 A * 10/1867 Landis ..... B68C 3/00 54/47
342,162 A * 5/1886 Allen ..... B68C 3/00 267/69
396,179 A * 1/1889 Taylor ..... B68C 3/00 54/47
D32,254 S * 2/1900 Goodman ..... 54/47
D33,690 S * 12/1900 Goodman ..... 54/47
699,472 A * 5/1902 Aughey et al. ..... B68C 3/00 54/47
878,837 A * 2/1908 Turner ..... B68C 3/00 54/47
995,166 A * 6/1911 Metzel ..... B68C 3/02 54/49
1,384,627 A * 7/1921 Olmstead ..... B68C 3/00 54/47
1,991,648 A * 2/1935 Armentrout ..... B68C 3/00 54/48
4,936,081 A * 6/1990 Jones ..... B68C 3/00 54/48
5,172,538 A * 12/1992 Luger ..... B68C 3/00 54/47

(Continued)

FOREIGN PATENT DOCUMENTS

DE 4221967 A1 * 2/1993 ..... B68C 3/025
DE 10347001 B3 * 5/2005 ..... B68C 3/00

(Continued)

OTHER PUBLICATIONS

Machine translation of DE 202014007041 to Haeberger, dated Sep. 2014.*

*Primary Examiner* — Kathleen Alker
(74) *Attorney, Agent, or Firm* — David Alan Lingbeck

(57) ABSTRACT

A stirrup device for properly positioning the rider's feet while riding. The stirrup device includes a support ring with holes disposed through one side of the support ring and with apertures disposed through an opposed side of the support ring and also includes a foot support adjustably positioned upon the support ring in relationship to the holes and apertures.

4 Claims, 2 Drawing Sheets

(56) References Cited

U.S. PATENT DOCUMENTS

| | | | | |
|---|---|---|---|---|
| 2010/0300050 | A1* | 12/2010 | Vollmecke | B68C 3/00 54/47 |
| 2016/0046481 | A1* | 2/2016 | Benetti | B68C 3/00 54/47 |
| 2016/0229682 | A1* | 8/2016 | Ford | B68C 3/00 |

FOREIGN PATENT DOCUMENTS

| | | | | |
|---|---|---|---|---|
| DE | 202008016720 | U1 * | 3/2009 | B68C 3/00 |
| DE | 202014007041 | U1 * | 9/2014 | B68C 3/00 |
| EP | 0193669 | A1 * | 9/1986 | B68C 3/02 |
| EP | 1961695 | A1 * | 8/2008 | B68C 3/00 |

* cited by examiner

STIRRUP DEVICE

CROSS-REFERENCE TO RELATED APPLICATIONS

The present application claims the benefit of the U.S. non-provisional application Appl. No. 62/085,861, filed on Dec. 1, 2014, the disclosure of which is expressly incorporated by reference herein in its entirety.

BACKGROUND OF THE INVENTION

Field of the Invention

The present invention relates to stirrups and more particularly pertains to a new stirrup device for properly positioning the rider's feet while riding.

Description of the Prior Art

The use of stirrups is known in the prior art. More specifically, stirrups heretofore devised and utilized are known to consist basically of familiar, expected and obvious structural configurations, notwithstanding the myriad of designs encompassed by the crowded prior art which have been developed for the fulfillment of countless objectives and requirements.

The prior art includes a riding stirrup with a hanger rod for connecting the stirrup to a saddle, and a stirrup loop connected to the hanger rod. The stirrup loop also includes an elongated base support tread positioned generally at the bottom of the loop. The base support tread extends at a slant with respect to a stirrup centerline which extends perpendicular to the longitudinal axis of the hanger rod. Another prior art includes stirrup leathers engaged with a pair of stirrups, each of the stirrups providing a support bar; a pair of spaced apart stirrup sides; and a linear foot support. The foot support and the support bar are fastened between the stirrup sides with the foot support and support bar spaced apart for admitting a riding boot supporting on the foot support. Also, another prior art includes a ramp or inclined footrest designed to support a foot supporting thereupon in an angled orientation characterized by the toes being above the heel. The top surface of the ramp or inclined footrest includes a friction surface to grip a foot supporting thereupon. Further, another prior art includes a Stirrup for horseback riding formed by two branches connected to the ends of a bearing support for the foot of the rider mounted pivotally about an axis connecting the two branches. Also, another prior art includes a stirrup pad for equitation with a top member defining a surface for contacting at least a portion of a heel of the rider's foot or footwear and at least one side edge, and a rear member defining a surface for contacting at least a portion of a heel of the rider's foot or footwear. The rear member extends downwardly from the top member side edge. Yet, another prior art includes a shock absorbing equestrian stirrup with a generally stirrup-shaped rigid structure having a substantially horizontal tread portion with a cushion thereon, two upright side portions joined near their top ends by a support bar and further including a ring of elastomeric energy absorbing material. While these devices fulfill their respective, particular objectives and requirements, the aforementioned patents do not disclose a new stirrup device.

SUMMARY OF THE INVENTION

The general purpose of the present invention, which will be described subsequently in greater detail, is to provide a new stirrup device which has many of the advantages of the stirrups mentioned heretofore and many novel features that result in a new stirrup device which is not anticipated, rendered obvious, suggested, or even implied by any of the prior art stirrups, either alone or in any combination thereof. The present invention includes a support ring with holes disposed through one side of the support ring and with apertures disposed through an opposed side of the support ring and also includes a foot support adjustably positioned upon the support ring in relationship to the holes and apertures. None of the prior art includes the combination of the elements of the present invention.

There has thus been outlined, rather broadly, the more important features of the stirrup device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new stirrup device which has many of the advantages of the stirrups mentioned heretofore and many novel features that result in a new stirrup device which is not anticipated, rendered obvious, suggested, or even implied by any of the prior art stirrups, either alone or in any combination thereof.

Still another object of the present invention is to provide a new stirrup device for properly positioning the rider's feet while riding.

Still yet another object of the present invention is to provide a new stirrup device that allows the user to adjust the foot support relative to the support ring.

Even still another object of the present invention is to provide a new stirrup device that allows the rider to tilt the foot support laterally relative to the support ring as desired by the rider.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
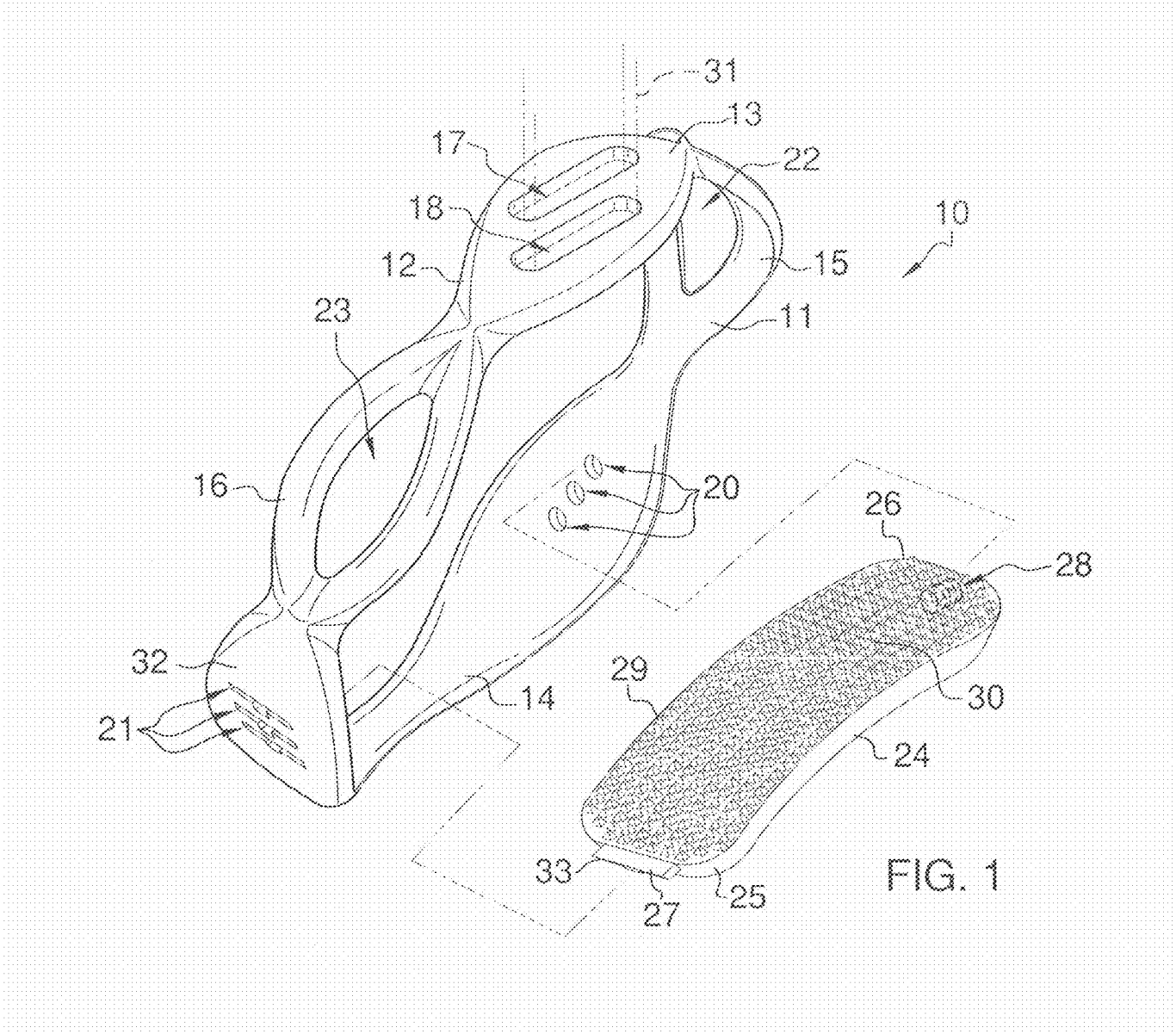
FIG. 1 is a top left exploded perspective view of a new stirrup device according to the present invention.
Figure 2:
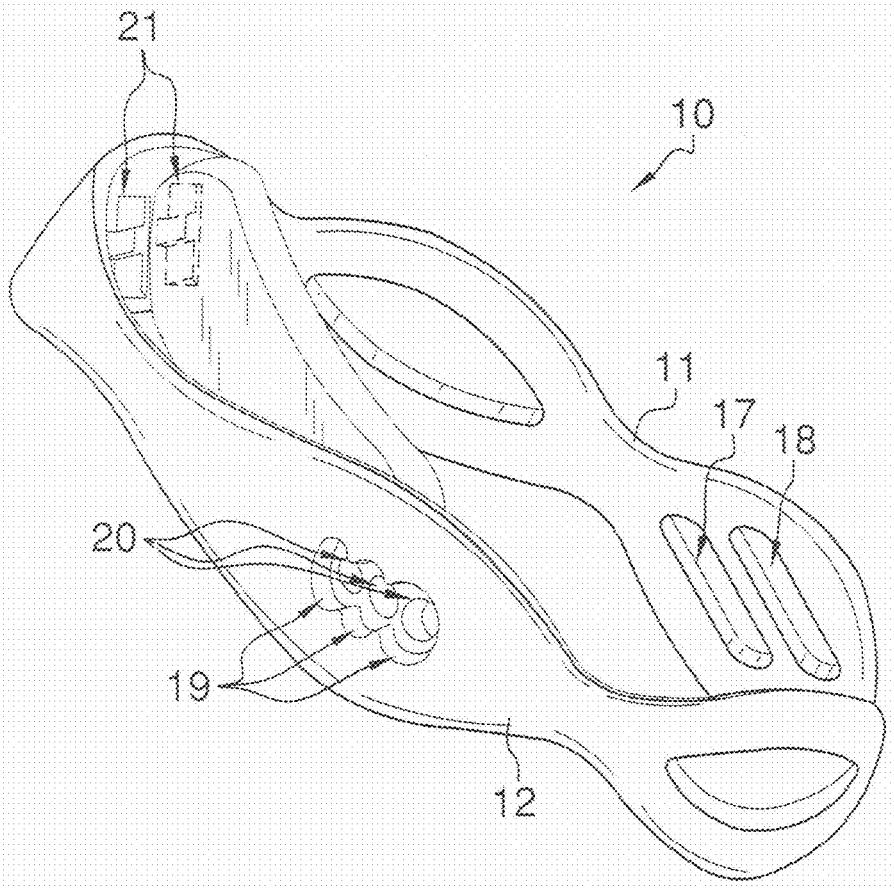
FIG. 2 is a bottom right perspective view of the stirrup device.

With reference now to the drawings, and in particular to FIGS. 1 and 2 thereof, a new stirrup device embodying the principles and concepts of the present invention and generally designated by the reference numeral 10 will be described.

As best illustrated in FIGS. 1 and 2, the stirrup device 10 generally may comprise a support ring 11 with an annular wall 12, a top 13, a bottom portion 14 and opposed sides 15, 16 and may also comprise an elongate planar foot support 24 with a top 29 and opposed ends 25, 26 and adjustably supported upon the support ring 11. The support ring 11 may also have elongate slots 17, 18 disposed through the annular wall 12 at the top 13 of the support ring 11 with the elongate slots 17, 18 longitudinally extended at an angle relative to a circumferential axis and transverse axis of the annular wall 12 for receiving a hanging strap 31 so that the support annular wall 12 will be laterally positioned relative to a horse The support ring 11 may further have holes 20 disposed through the annular wall 12 and spaced along one of the sides 15 of the support ring 11 and may further have recessed portions 19 disposed in an outer side 32 of the annular wall 12 and disposed about the holes 20. The support ring 11 may also include polygonal-shaped apertures 21 disposed through the annular wall 12 and spaced along the other side 16 opposed to the side 15 with the holes 20. In addition, the support ring 11 may have elongate openings 22, 23 disposed through the annular wall 12 and extending from the top 13 and along the sides 15, 16 of the support ring 11.

As shown in FIGS. 1 and 2, the planar foot support 24 may also include a rigid projecting tab 27 integrally extending outwardly from one of the ends 25 of the planar foot support 24 and is removably received in any one of the apertures 21 of the support ring 11 to secure the foot support 24 in a selected position upon the support ring 11. The planar foot support 24 may further include a threaded hole 28 disposed in the other end 26 opposed to the end 25 with the projecting tab 27 for receiving a fastener to secure the foot support 24 to one of the holes 20 with the projecting tab 27 secured to one of the apertures 21 with a longitudinal axis of the foot support 24 adjustably positioned anywhere between 60 degrees to 120 degrees relative to a plane passing through the elongate openings 22, 23 at the top 13 of the support ring 11. The projecting tab 27 may have a polygonal-shaped outer end 33 to match the polygonal-shaped apertures 21 to prevent lateral rotation of the foot support 24 when secured to the support ring 11. In addition, the planar foot support 24 may have a gripping knurled surface 30 on the top 29 to prevent slippage of the rider's feet upon the foot support 24.

In use, the rider may depend the stirrup device 10 from the hanging strap 31 on a horse and may position at the proper longitudinal angle the foot support 24 within and upon the support ring 11 by inserting the projecting tab 27 in one of the apertures 21 and then using a proper tool to fasten the other end 26 of the foot support 24 to one of the holes 20 of the support ring 11 so that the bottom of the rider's feet would be essentially parallel to the ground surface while riding the horse. The foot support 24 is longitudinally arranged relative to the elongate openings 22,23 and the foot support 24 is secured to the one of the holes 20 and one of the apertures 19. The support foot 24 is positioned with a longitudinal axis of the foot support 24 positioned anywhere between 60 degrees to 120 degrees relative to a plane passing through the elongate openings 22,23 at the top 13 of the support ring 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the stirrup device. Further, since numerous modifications and charges will readily occur to those skilled in the art, it is not desired to limit the invention to the exact construction and operation shown and described, and accordingly, all suitable modifications and equivalents may be resorted to, falling within the scope of the invention.

I claim:

1. A stirrup device comprising:

a rigid support ring with an annular wall, a top, a bottom portion and opposed sides, wherein the support ring also has holes disposed through the annular wall and spaced along one of the sides of the support ring, wherein the support ring also includes polygonal -shaped apertures disposed through the annular wall and spaced along the other side opposed to the side with the holes, wherein the support ring further includes elongate openings disposed through the annular wall and extending from the top and along the sides of the support ring; and an elongate planar foot support with a top and opposed ends and adjustably supported upon the support ring, wherein the planar foot support includes a projecting tab extending outwardly from one of the ends of the planar foot support and is removably received in one of the apertures of the support ring to secure the foot support in a selected position upon the support ring.

2. The stirrup device as described in claim 1, wherein the planar foot support also includes a threaded hole disposed in the other end opposed to the end with the projecting tab for receiving a fastener to secure the foot support to one of the holes with the projecting tab secured to one of the apertures with a longitudinal axis of the foot support adjustably positioned anywhere between 60 degrees to 120 degrees relative to a plane passing through the elongate openings at the top of the support ring.

3. The stirrup device as described in claim 2, wherein the projecting tab has a polygonal-shaped outer end to prevent lateral rotation of the foot support when secured to the support ring.

4. The stirrup device as described in claim 2, wherein the planar foot support has a gripping knurled surface on the top to prevent slippage of a rider's feet upon the foot support.

* * * * *